US010564560B2

(12) United States Patent
Onozaki et al.

(10) Patent No.: US 10,564,560 B2
(45) Date of Patent: Feb. 18, 2020

(54) TONER

(71) Applicant: CANON KABUSHIKI KAISHA, Tokyo (JP)

(72) Inventors: Yuto Onozaki, Saitama (JP); Takeshi Hashimoto, Moriya (JP); Ichiro Kanno, Kashiwa (JP); Masayuki Hama, Toride (JP); Nozomu Komatsu, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/996,884

(22) Filed: Jun. 4, 2018

(65) Prior Publication Data

US 2018/0364601 A1 Dec. 20, 2018

(30) Foreign Application Priority Data

Jun. 16, 2017 (JP) ..... 2017-118318

(51) Int. Cl.
*G03G 9/097* (2006.01)
*G03G 9/087* (2006.01)
*G03G 9/08* (2006.01)

(52) U.S. Cl.
CPC ..... *G03G 9/09733* (2013.01); *G03G 9/0819* (2013.01); *G03G 9/08755* (2013.01); *G03G 9/08795* (2013.01); *G03G 9/09791* (2013.01)

(58) Field of Classification Search
CPC ..... G03G 9/09733; G03G 9/0819; G03G 9/08755
See application file for complete search history.

(56) References Cited

U.S. PATENT DOCUMENTS 5,968,701 A 10/1999 Onuma et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,430,384 B2 8/2002 Hama et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
7,112,395 B2 9/2006 Ida et al.
7,147,980 B2 12/2006 Itakura et al.
7,147,981 B2 12/2006 Fujikawa et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,361,441 B2 4/2008 Itakura et al.
7,396,626 B2 7/2008 Fujikawa et al.
7,396,629 B2 7/2008 Baba et al.
7,442,478 B2 10/2008 Itakura et al.
7,452,647 B2 11/2008 Hayami et al.
7,611,813 B2 11/2009 Ida et al.
7,858,283 B2 12/2010 Ishigami et al.
7,927,775 B2 4/2011 Komatsu et al.
7,939,233 B2 5/2011 Inoue et al.
8,137,886 B2 3/2012 Baba et al.
8,142,972 B2 3/2012 Hotta et al.
8,288,069 B2 10/2012 Fujikawa et al.
8,921,023 B2 12/2014 Baba et al.
8,927,188 B2 1/2015 Naka et al.
8,986,914 B2 3/2015 Fujikawa et al.
9,034,549 B2 5/2015 Shiotari et al.
9,058,924 B2 6/2015 Komatsu et al.
9,063,443 B2 6/2015 Ishigami et al.
9,152,088 B1 10/2015 Kobori et al.
9,348,253 B2 5/2016 Kanno et al.
9,417,540 B2 8/2016 Hashimoto et al.
9,500,975 B2 11/2016 Sugahara et al.
9,594,323 B2 3/2017 Fujikawa et al.
9,599,920 B2 3/2017 Sugahara et al.
9,651,883 B2 5/2017 Hama et al.
9,665,023 B2 5/2017 Kamae et al.
9,665,026 B2 5/2017 Iwasaki et al.
9,778,598 B2 10/2017 Onozaki et al.
9,958,809 B2 5/2018 Sugahara et al.
2009/0087767 A1* 4/2009 Nakamura ..... G03G 9/0906 430/108.2
2009/0246675 A1 10/2009 Nakamura et al.
2009/0280427 A1* 11/2009 Kunii ..... G03G 9/0821 430/109.4

(Continued)

FOREIGN PATENT DOCUMENTS

JP 2001-330994 A 11/2001
JP 2006-126529 A 5/2006

OTHER PUBLICATIONS

U.S. Appl. No. 15/886,965, Takeshi Hashimoto, filed Feb. 2, 2018.
U.S. Appl. No. 15/912,698, Hitoshi Sano, filed Mar. 6, 2018.
U.S. Appl. No. 15/955,291, Megumi Ikeda, filed Apr. 17, 2018.
U.S. Appl. No. 15/992,467, Masayuki Hama, filed May 30, 2018.

*Primary Examiner* — Thorl Chea
(74) *Attorney, Agent, or Firm* — Venable LLP

(57) ABSTRACT

Provided is a toner having a toner particle, wherein the toner particle contains a polyester resin and a fatty acid metal salt, the toner contains a tetrahydrofuran-soluble component A with a molecular weight of at least 1,000 and not more than 5,000, as measured by gel permeation chromatography, in an amount of at least 25 mass % and not more than 80 mass %, and a mass ratio of the fatty acid metal salt to the tetrahydrofuran-soluble component A is at least 0.003 and not more than 0.060.

8 Claims, 1 Drawing Sheet

(56) References Cited

U.S. PATENT DOCUMENTS

| | | | |
|---|---|---|---|
| 2010/0028796 | A1 | 2/2010 | Nakamura et al. |
| 2010/0183971 | A1 | 7/2010 | Fujikawa et al. |
| 2013/0244159 | A1 | 9/2013 | Ishigami et al. |
| 2014/0134535 | A1 | 5/2014 | Baba et al. |
| 2014/0329176 | A1 | 11/2014 | Kanno et al. |
| 2016/0109820 | A1 | 4/2016 | Hashimoto et al. |
| 2016/0363877 | A1 | 12/2016 | Hama et al. |
| 2017/0315461 | A1 | 11/2017 | Komatsu et al. |
| 2017/0315463 | A1 | 11/2017 | Onozaki et al. |
| 2017/0343911 | A1 | 11/2017 | Hashimoto et al. |
| 2017/0357168 | A1 | 12/2017 | Kanno et al. |
| 2018/0149990 | A1 | 5/2018 | Onozaki et al. |
| 2018/0149992 | A1 | 5/2018 | Onozaki et al. |

* cited by examiner

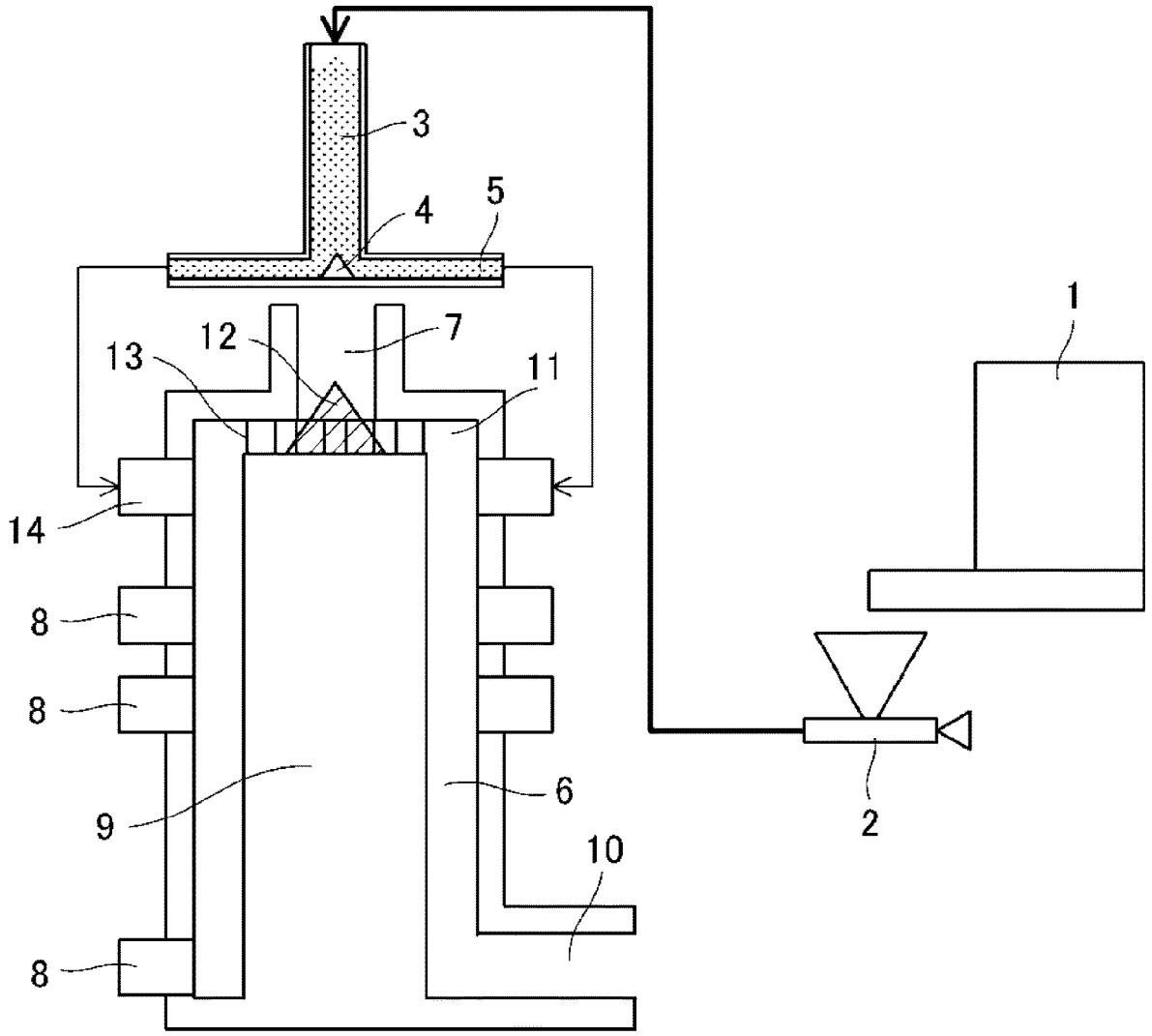
3
4
5
1
12
7
13
11
14
8
8
9
6
2
10
8

TONER

BACKGROUND OF THE INVENTION

Field of the Invention

The present invention relates to a toner for use in electrophotographic systems, electrostatic recording systems, electrostatic printing systems and toner jet systems.

Description of the Related Art

In recent years, energy conservation has come to be regarded as a major technical issue in the field of electrophotographic devices, and large reductions in the amount of heat applied to the fixing apparatus are being studied. In the context of the toner, this means increased demand for "low-temperature fixability" to allow fixing with less energy. There is also demand for durable stability so that image quality does not decline in offices in which large numbers of prints are produced.

Various strategies are being studied for improving the toner structure and the release agent in order to address such issues of low-temperature fixability and durable stability of the toner and the like.

For example, Japanese Patent Application Publication No. 2006-126529 proposes a toner containing a binder resin with a high softening point and a fatty acid metal salt.

SUMMARY OF THE INVENTION

The toner described in Japanese Patent Application Publication No. 2006-126529 achieves durable stability by combining a binder resin with a high softening point with a fatty acid metal salt having a mold release effect, but it still suffers from inadequate low-temperature fixability.

According to Japanese Patent Application Publication No. 2001-330994, one way of improving low-temperature fixability while maintaining the durable stability of the toner is to use two polyesters with different softening points as binder resins.

The low-temperature fixability of the toner is improved by the polyester with the lower softening point, while the durable stability is improved by the polyester with the higher softening point.

However, the toner described in Japanese Patent Application Publication No. 2001-330994 has had a problem of poor hot offset properties in high-temperature environments.

Therefore, the present invention provides a toner that resolves these problems. Specifically, it provides a toner having excellent low-temperature fixability and hot offset resistance, as well as high durable stability.

The present invention is a toner having a toner particle, wherein the toner particle contains a polyester resin and a fatty acid metal salt, the toner contains a tetrahydrofuran-soluble component A with a molecular weight of at least 1,000 and not more than 5,000, as measured by gel permeation chromatography, in an amount of at least 25 mass % and not more than 80 mass %, and a mass ratio of the fatty acid metal salt to the tetrahydrofuran-soluble component A is at least 0.003 and not more than 0.060.

With the present invention, it is possible to provide a toner having excellent low-temperature fixability and hot offset resistance, as well as high durable stability.

Further features of the present invention will become apparent from the following description of exemplary embodiments with reference to the attached drawing.

BRIEF DESCRIPTION OF THE DRAWING

The FIGURE is a diagram of a heat treatment apparatus.

DESCRIPTION OF THE EMBODIMENTS

In the present invention, unless otherwise specified, descriptions of numerical ranges such as "at least X and not more than Y" or "X to Y" include the numbers at the upper and lower limits of the range.

Moreover, the term monomer unit refers to the reacted form of the monomer material in a polymer or copolymer.

The toner of the present invention is a toner having a toner particle, wherein the toner particle contains a polyester resin and a fatty acid metal salt, the toner contains a tetrahydrofuran-soluble component A with a molecular weight of at least 1,000 and not more than 5,000, as measured by gel permeation chromatography, in the amount of at least 25 mass % and not more than 80 mass %, and the mass ratio of the fatty acid metal salt to the tetrahydrofuran-soluble component A (hereinafter, simply referred to as a "component A") is at least 0.003 and not more than 0.060.

The reason why the toner has excellent hot offset resistance is believed to be as follows.

As the fatty acid metal salt melts in the toner particle in the fixing temperature range, it is predicted that part of the fatty acid metal salt will dissociate into metal ions and fatty acid. Because the carboxyl groups for example contained in the component A in the toner particle are electron-rich functional groups, they are presumed to coordinate with the metal ions in the toner particle. The component A thus becomes linked with itself via metal ions, facilitating entanglement of the resin. It is thought that the elastic modulus of the toner is increased as a result, thereby improving the hot offset resistance.

It is thought that the reason why the toner has excellent low-temperature fixability is that the alkyl chains of the fatty acid plasticize the binder resin in the toner particle.

A tetrahydrofuran (THF)-soluble component A with a molecular weight of at least 1,000 and not more than 5,000 as measured by gel permeation chromatography (GPC) is contained in the toner in the amount of at least 25 mass % and not more than 80 mass %.

If the content is less than 25 mass %, there are too few carboxyl groups in the component A capable of coordinating with metal ions. It is thought that because of this, the component A cannot become linked via the metal ions, making it difficult to increase the elastic modulus of the toner. Consequently, the toner is insufficiently elastic when it is fixed to the paper, and hot offset resistance is reduced.

If the content exceeds 80 mass %, on the other hand, it is thought that the plasticizing effect of the alkyl chains of the fatty acid is greater than the effect of the metal ions. As a result, the toner is insufficiently elastic when it is fixed on the paper, and hot offset resistance may be reduced.

The content of the component A is preferably at least 30 mass % and not more than 75 mass %, or more preferably at least 40 mass % and not more than 70 mass %.

One method of controlling the content of the component A within the aforementioned range is to include a polyester resin with a molecular weight of at least 1,000 and not more than 5,000 when manufacturing the toner.

The fatty acid metal salt is a compound having metal ions substituted for hydrogen ions in a fatty acid.

The following metal ions are desirable examples of the metal ions:

as univalent metal ions, $Na^+$, $K^+$, $Cs^+$, $Ag^+$, $Hg^+$ and $Cu^+$;

as bivalent metal ions, $Be^{2+}$, $Ba^{2+}$, $Mg^{2+}$, $Ca^{2+}$, $Hg^{2+}$, $Pb^{2+}$, $Mn^{2+}$, $Fe^{2+}$, $Co^{2+}$, $Ni^{2+}$ and $Zn^{2+}$;

as trivalent ions, $Al^{3+}$, $Sc^{3+}$, $Fe^{3+}$, $V^{3+}$, $Co^{3+}$, $Ce^{3+}$, $Ni^{3+}$, $Cr^{3+}$ and $Y^{3+}$; and as tetravalent ions, $Ti^{4+}$ and $Zr^{4+}$.

Metal ions other than those listed above have large ion radii relative to the carboxyl groups of the component A, which makes coordination difficult and tends to detract from the effect of hot offset resistance.

Of these, the univalent, bivalent and trivalent metal ions are preferred, and $Li^+$, $Ba^{2+}$, $Mg^{2+}$, $Ca^{2+}$, $Zn^{2+}$, $Al^{3+}$ and the like are more preferred.

The carbon number of the fatty acid in the fatty acid metal salt is preferably at least 8 and not more than 28, or more preferably at least 12 and not more than 18.

If the carbon number is within this range, compatibility with the resin component is high, and the fatty acid metal salt can be thoroughly dispersed in the toner particle. Moreover, the crosslinking effect of the metal ions is balanced with the plasticizing effect of the alkyl chains of the fatty acid, and a greater improvement in hot offset resistance can be achieved.

Examples of fatty acids with a carbon number of at least 8 and not more than 28 include caprylic acid (octanoic acid), pelargonic acid (nonanoic acid), capric acid (decanoic acid), lauric acid (dodecanoic acid), myristic acid (tetradecanoic acid), pentadecanoic acid, palmitic acid (hexadecanoic acid), 9-hexadecenoic acid, heptadecanoic acid, stearic acid (octadecanoic acid), 12-hydroxystearic acid, 11-octadecenoic acid, eicosanoic acid, docosanoic acid (behenic acid), tetracosanoic acid, hexacosanoic acid, octacosanoic acid (montanic acid) and the like.

Of these, preferred examples include fatty acids such as stearic acid, 12-hydroxystearic acid, behenic acid, montanic acid and lauric acid.

One fatty acid metal salt or a combination of two or more kinds may be used.

In the fatty acid metal salt, metal ions may be substituted for hydrogen atoms of the fatty acid in the same number as the valence of the metal, and these are also examples of fatty acid metal salts.

Examples of the fatty acid metal salt include calcium laurate, calcium dilaurate, barium laurate, barium dilaurate, magnesium stearate, magnesium distearate, zinc stearate, zinc distearate, aluminum stearate, lithium stearate, calcium stearate, calcium distearate, magnesium 12-hydroxystearate, magnesium di-12-hydroxystearate, aluminum dimontanate and the like.

Of these, magnesium stearate, magnesium distearate, calcium laurate, calcium dilauarate and the like are preferred.

At least one fatty acid metal salt selected from the group consisting of magnesium stearate, magnesium distearate, calcium laurate and calcium dilaurate is preferably included as the fatty acid metal salt.

The melting point of the fatty acid metal salt is preferably at least 70° C. and not more than 170° C., or more preferably at least 120° C. and not more than 165° C.

If the melting point of the fatty acid metal salt is within this range, it is easy to balance the plasticizing effect of the fatty acid metal salt with the hot offset resistance effect. That is, within the fixing temperature range part of the fatty acid metal salt can sufficiently dissociate into metal ions and fatty acid, thereby supplying enough metal ions for coordinating with the component A, so that hot offset resistance can be improved. Low-temperature fixability can also be further improved due to the suitable plasticizing effect of the fatty acid metal salt.

The mass ratio of the fatty acid metal salt to the tetrahydrofuran-soluble component A (fatty acid metal salt/tetrahydrofuran-soluble component A) is preferably at least 0.003 and not more than 0.060, or more preferably at least 0.005 and not more than 0.050.

If the mass ratio is within this range, the quantity of metal ions capable of coordinating with the carboxyl groups in the component A is sufficient, so that the component A can become linked with itself via the metal ions, thereby easily raising the elastic modulus of the toner so that hot offset resistance can be further improved.

By linking the component A with itself via the metal ions, moreover, it is possible to reduce the molecular movement of the component A in high-temperature environments. Furthermore, the molecular movement of the resin itself can be suitably controlled even when a sufficient plasticizing effect has been achieved with the polyester resin by the fatty acid sites of the fatty acid metal salt. It is thus possible to suppress charge leakage from the toner particle, and further stabilize the charge quantity of the toner.

On the other hand, low-temperature fixability can also be further improved because a suitable balance is achieved between the crosslinking effect of the metal ions and the plasticizing effect of the alkyl chains of the fatty acid.

In a cross-section of the toner particle under a transmission electron microscope, the number-average dispersion diameter of the fatty acid metal salt is preferably at least 50 nm and not more than 500 nm, or more preferably at least 50 nm and not more than 300 nm.

When the number-average dispersion diameter of the fatty acid metal salt is within this range, the effects of low-temperature fixability and hot offset resistance are more easily achieved because the contact area between the fatty acid metal salt and the component A can be controlled to a suitable degree.

One method of controlling number-average dispersion diameter of the fatty acid metal salt within the aforementioned range is by controlling the toner manufacturing conditions. When a pulverization method is used for example, this can be done by controlling the shearing speed and temperature conditions when melt kneading the materials.

The content of the fatty acid metal salt is preferably at least 0.1 mass parts and not more than 5.0 mass parts, or more preferably at least 0.5 mass parts and not more than 2.0 mass parts per 100 mass parts of the polyester resin.

The toner particle contains a polyester resin as a binder resin.

The binder resin may be composed solely of the polyester resin, or it may contain a resin other than the polyester resin. Examples of the resin other than the polyester resin include known resins used in toners, such as those discussed below.

The content of the polyester resin in the binder resin is preferably at least 50 mass % and not more than 100 mass %, or more preferably at least 70 mass % and not more than 100 mass %, or still more preferably at least 90 mass % and not more than 100 mass %.

The polyester resin is not particularly limited, and examples include condensates of alcohol components and acid components.

Specifically, the polyester resin may be one containing a monomer unit derived from the following alcohol components and a monomer unit derived from the following acid components.

Examples of the alcohol component and acid component include polyvalent alcohols (bivalent and trivalent or higher alcohols) and polyvalent carboxylic acids (bivalent and trivalent or higher carboxylic acids) and acid anhydrides thereof, and lower alkyl esters of these.

Partial crosslinking within the molecule of the polyester resin is effective for preparing a branched polymer, and trivalent or higher polyvalent compounds are preferred for this purpose.

Specifically, when preparing a branched polymer, a trivalent or higher carboxylic acid or acid anhydride or a lower alkyl ester thereof and/or a trivalent or higher alcohol may be included as a raw material monomer.

The following are specific examples of the polyvalent alcohol.

Examples of bivalent alcohols include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by formula (I) below and its derivatives, and diols represented by formula (II) below and the like.

(I)

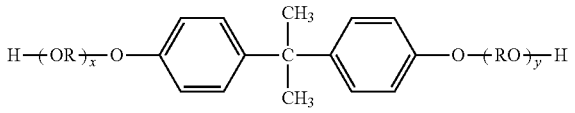

(Where, R represents an ethylene group or propylene group, each of x and y represents 0 or an integer greater than 0, and the average of x+y is at least 0 and not more than 10.)

(II)

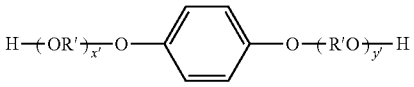

(Where, R' represents:

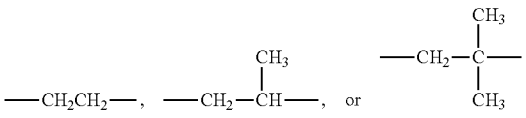

each of x' and y' represents 0 or an integer greater than 0, and the average of x'+y' is at least 0 and not more than 10.)

Examples of trivalent or higher alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene. Of these, examples include glycerol, trimethylolpropane and pentaerythritol.

These bivalent alcohols and trivalent and higher alcohols may be used individually, or multiple kinds may be combined.

Specific examples of the polyvalent carboxylic acid are as follows.

Examples of bivalent carboxylic acids include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, acid anhydrides thereof, and a lower alkyl esters thereof. Of these, maleic acid, fumaric acid, terephthalic acid and n-dodecenylsuccinic acid are desirable examples.

Examples of trivalent or higher carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy)methane, 1,2,7,8-octanetetracarboxylic acid, pyromellitic acid and Empol trimer acid. Acid anhydrides thereof and lower alkyl esters of these may also be used.

Of these, 1,2,4-benzenetricarboxylic acid (trimellitic acid) or its acid anhydride is preferred for its low price and ease of reaction control.

The bivalent carboxylic or trivalent or higher carboxylic acids may be used individually, or multiple kinds may be combined.

From the standpoint of charge stability, the acid value of the polyester resin is preferably at least 1 mg KOH/g and not more than 50 mg KOH/g, or more preferably at least 1 mg KOH/g and not more than 30 mg KOH/g.

A low-molecular-weight polyester resin (L) and a high-molecular-weight polyester resin (H) may be mixed and used as the polyester resin.

In this case, the mass ratio (H/L) of the high-molecular-weight polyester resin (H) to the low-molecular-weight polyester resin (L) is preferably at least 10/90 and not more than 60/40 from the standpoint of low-temperature fixability and hot offset resistance.

From the standpoint of low-temperature fixability, the softening point of the polyester resin (L) is preferably at least 70° C. and not more than 100° C.

Moreover, from the standpoint of low-temperature fixability and hot offset resistance, the peak molecular weight (Mp) of the polyester resin (L) is preferably at least 2,500 and not more than 7,000, or more preferably at least 3,500 and not more than 6,500.

On the other hand, from the standpoint of hot offset resistance the softening point of the polyester resin (H) is preferably at least 100° C. and not more than 150° C.

From the standpoint of low-temperature fixability and hot offset resistance, the peak molecular weight (Mp) of the polyester resin (H) is preferably at least 9,000 and not more than 13,000, or more preferably at least 10,000 and not more than 12,000.

Also, in the polyester resin a tetrahydrofuran-soluble component with a molecular weight of at least 1,000 and not more than 5,000 as measured by gel permeation chromatography is preferably contained in the amount of at least 25 mass % and not more than 80 mass %, or more preferably at least 35 mass % and not more than 75 mass %.

The toner particle may also contain a resin other than the polyester resin as a binder resin to the extent that this does not detract from the effects of the invention.

The following are examples of resins other than the polyester resin: monopolymers of styrenes and substituted forms thereof such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyurethane, polyamide resin, furan resin, epoxy resin, xylene resin, polyvinylbutyral, terpene resin, coumarone-indene resin and petroleum-based resin.

Of these, polystyrene and styrene acrylic resins such as styrene-acrylate ester copolymers and styrene-methacrylate ester copolymers are preferred.

When this resin is included, dispersibility of the release agent in the toner particle is improved, and charge stability is further improved. The content of the resin is preferably at least 1 mass part and not more than 10 mass parts per 100 mass parts of the polyester resin.

The toner particle may also contain a colorant. The following are examples of colorants.

Examples of black colorants include carbon black, and blacks obtained by color matching, i.e., blending yellow, magenta and cyan colorants.

A pigment may be used alone as the colorant, but from the standpoint of image quality with full-color images, preferably a dye and a pigment are used together to improve the color clarity.

Examples of magenta pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. Pigment Violet 19; and C.I. Vat Red 1, 2, 10, 13, 15, 23, 29 and 35.

Examples of magenta dyes include C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; oil-soluble dyes such as C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39 and 40 and C.I. Basic Violet 1, 3, 7, 10, 14, 15, 21, 25, 26, 27 and 28.

Examples of cyan pigments include C.I. Pigment Blue 2, 3, 15:2, 15:3, 15:4, 16 and 17; C.I. Vat Blue 6; C.I. Acid Blue 45, and copper phthalocyanine pigments having 1 to 5 phthalimidomethyl groups substituted on a phthalocyanine skeleton.

Examples of cyan dyes include C.I. Solvent Blue 70.

Examples of yellow pigments include C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3, and 20.

Examples of yellow dyes include C.I. Solvent Yellow 162.

The content of the colorant is preferably at least 0.1 mass parts and not more than 30 mass parts per 100 mass parts of the polyester resin.

The toner particle may also contain a release agent. The release agent is not particularly limited, and a known wax may be used.

Examples of this wax include the following: hydrocarbon waxes such as low-molecular-weight polyethylene, low-molecular-weight polypropylene, alkylene copolymers, microcrystalline wax, paraffin wax and Fischer-Tropsch wax; hydrocarbon wax oxides such as polyethylene oxide wax, and block copolymers of these; waxes consisting primarily of fatty acid esters, such as carnauba wax; and partially or fully deoxidized fatty acid esters, such as deoxidized carnauba wax. Other examples include the following: saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, seryl alcohol and melissyl alcohol; polyvalent alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, seryl alcohol and mellisyl alcohol; fatty acid amides such as linoleamide, oleamide and lauramide; saturated fatty acid bisamides such as methylenebis stearamide, ethylenebis capramide, ethylenebis lauramide and hexamethylenebis stearamide; unsaturated fatty acid amides such as ethylenebis oleamide, hexamethylenebis oleamide, N,N'-dioleyladipamide and N,N'-dioleylsebacamide; aromatic bisamides such as m-xylenebis stearamide and N,N'-distearylisophthalamide; aliphatic hydrocarbon waxes grafted with vinyl monomers such as styrene or acrylic acid; partial esterified products of fatty acids and polyvalent alcohols, such as behenic acid monoglyceride; and methyl ester compounds with hydroxyl groups obtained by hydrogenation of plant-based oils and fats.

Of these, a hydrocarbon wax such as paraffin wax or Fischer-Tropsch wax or a fatty acid ester wax such as carnauba wax is preferred for improving low-temperature fixability and hot offset resistance. A hydrocarbon wax is especially preferred from the standpoint of hot offset resistance.

The content of the release agent is preferably at least 1 mass part and not more than 20 mass parts per 100 mass parts of the polyester resin.

In an endothermic curve obtained during temperature rise by differential scanning calorimetry (DSC), the peak temperature of the maximum endothermic peak of the release agent is preferably at least 45° C. and not more than 140° C., or more preferably at least 70° C. and not more than 110° C., or still more preferably at least 80° C. and not more than 100° C.

When the peak temperature of the maximum endothermic peak of the release agent is within this range, it is easy to obtain both storability and hot offset resistance of the toner.

The toner particle may also contain a charge control agent as necessary.

A known charge control agent may be used, but a metal compound of an aromatic carboxylic acid is especially desirable because it is colorless and yields a toner particle that has a rapid charging speed and can stably maintain a certain charge quantity.

Examples of negatively-charging charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes.

Examples of positively-charging charge control agents include quaternary ammonium salts, polymeric compounds having quaternary ammonium salts in the side chains, and guanidine compounds and imidazole compounds.

The charge control agent may be added either internally or externally to the toner particle.

The content of the charge control agent is preferably at least 0.05 mass parts and not more than 5 mass parts per 100 mass parts of the polyester resin.

The toner may also contain an inorganic fine particle as necessary.

The inorganic fine particle may be added internally to the toner particle, or mixed with the toner particle as an external additive.

An inorganic fine particle such as a silica fine particle, titanium oxide fine particle or aluminum oxide fine particle may be used as an external additive.

The inorganic fine particle is preferably a particle that has been hydrophobically treated with a hydrophobic agent such as a silane compound, silicone oil or a mixture of these.

As an external additive for improving flowability, an inorganic fine particle with a specific surface area of at least 50 $m^2/g$ and not more than 400 $m^2/g$ as measured by the BET method is preferred. And the other hand, for purposes of improving durable stability an inorganic fine particle with a specific surface area of at least 10 $m^2/g$ and not more than 50 $m^2/g$ as measured by the BET method is preferred.

Inorganic fine particles with specific surface areas within these ranges may also be used together in order to achieve both improved flowability and durable stability.

The content of these external additives is preferably at least 0.1 mass parts and not more than 10.0 mass parts per 100 mass parts of the toner particle. Mixing of the toner particle with the external additive may be accomplished with a known apparatus such as a HENSCHEL MIXER.

The toner may be used as a one-component developer, but is preferably mixed with a magnetic carrier and used as a two-component developer in order to further improve dot reproducibility and obtain stable images over a long period of time.

Examples of the magnetic carrier include the following: surface-oxidized iron powders; non-oxidized iron powders; metal particles such as an iron, lithium, calcium, magnesium, nickel, copper, zinc, cobalt, manganese, chromium and rare earth particles; alloy particles of these; oxide particles and magnetic bodies such as ferrite; and magnetic body-dispersed resin carriers (so-called resin carriers) containing a binder resin that holds a magnetic body in a dispersed state and the like.

When the toner is mixed with a magnetic carrier and used as a two-component developer, the content of the toner in the two-component developer is preferably at least 2 mass % and not more than 15 mass %, or more preferably at least 4 mass % and not more than 13 mass %.

The toner manufacturing method is not particularly limited, and a known method may be used.

For example, in cases in which a low-molecular-weight polyester resin and a high-molecular-weight polyester resin are mixed and used together and the like, a pulverization method or emulsification method is preferred to facilitate dispersal of the fatty acid metal salt in the toner particle, and a pulverization method is especially preferred.

An example of a sequence of steps used to manufacture the toner by a pulverization method is explained below.

In a raw material mixing step, the materials constituting the toner particle, namely the polyester resin and fatty acid metal salt together with a release agent, colorant, charge control agent and other components as necessary, are weighed in specific quantities, compounded and mixed.

The mixing apparatus may be a double-cone mixer, V-shaped mixer, drum mixer, super mixer, HENSCHEL MIXER, Nauta mixer, Mechano Hybrid (Nippon Coke & Engineering Co., Ltd.) or the like for example.

Next, the mixed materials are melt kneaded to disperse the fatty acid metal salt and the like in the polyester resin. Either a batch kneader such as a pressure kneader or Banbury mixer or a continuous kneader may be used in this melt kneading step, and generally a single- or twin-screw extruder is used because it allows for continuous production.

Specific examples of kneading apparatuses include a KTK twin-screw extruder (Kobe Steel, Ltd.), TEM twin-screw extruder (Toshiba Machine Co., Ltd.), PCM kneader (Ikegai Iron Works Co., Ltd.), twin-screw extruder (KCK), Ko-kneader (Buss AG), Kneadex (Nippon Coke & Engineering Co., Ltd.) and the like.

The resulting melt kneaded material can then be rolled with two rolls or the like, and cooled with water or the like to obtained a cooled resin composition.

The resulting cooled material is then pulverized to the desired particle size in a pulverization step.

In the pulverization step, the material is first coarsely pulverized with a crushing apparatus such as a crusher, hammer mill or feather mill to obtain a coarsely pulverized product. This can then be then finely pulverized with a pulverizing apparatus such as a Kryptron system (Kawasaki Heavy Industries, Ltd.), Super Rotor (Nisshin Engineering Inc.), Turbo Mill (Turbo Kogyo) or air jet system.

This can then be classified as necessary with a sieving or classifying apparatus such as an Elbow Jet (Nittetsu Mining Co., Ltd.) using inertial classification or a Turboplex (Hosokawa Micron Corporation), TSP Separator (Hosokawa Micron Corporation) or Faculty (Hosokawa Micron Corporation) using centrifugal classification to obtain a toner particle.

The toner particle can then be subjected as necessary to surface treatment such as sphering treatment with a Hybridization system (Nara Machinery Co., Ltd.), Mechano-fusion system (Hosokawa Micron Corporation), Faculty (Hosokawa Micron Corporation) or Meteor Rainbow MR Type (Nippon Pneumatic Mfg. Co., Ltd.).

As to the method of surface treatment, heat treatment of the toner particle is desirable because it can easily increase the circularity of the toner particle, and increase transfer efficiency.

Moreover, the heat treatment may cause a large quantity of the release agent may be distributed near the surface of the toner particle, so that the release agent exerts a release effect more rapidly in the fixing step, thereby further improving hot offset resistance.

A method of heat-treating the toner particle is illustrated here by a specific example using the heat treatment apparatus shown in the FIGURE.

Resin particles are quantitatively supplied by a quantitative raw material supply means 1, and are conducted by compressed gas regulated by a compressed gas flow regulation means 2 to an introduction pipe 3 disposed on the vertical line of the raw material supply means. After passing through the introduction pipe 3, the resin particles are uniformly dispersed by a conical projecting member 4 disposed in the center of the raw material supply means, conducted to supply pipes 5 spreading radially in eight directions, and supplied through powder particle supply ports 14 to a treatment chamber 6 where they are heat treated.

During this process, the flow of the resin particles supplied to the treatment chamber 6 is regulated by a regulation means 9 provided in the treatment chamber 6 in order to regulate the flow of the resin particles. The resin particles supplied to the treatment chamber 6 are thus heat treated while circulating within the treatment chamber 6, and then cooled.

The hot air for heat-treating the supplied resin particles is supplied from a hot air supply means 7, distributed by a distribution member 12, and circulated spirally and introduced within the treatment chamber 6 by a circulation member 13 for circulating the hot air. The circulation member 13 for circulating the hot air is configured with multiple blades, and the circulation of the hot air may be controlled by means of the number and angle of the blades (11 shows the hot air supply means outlet). During this process, any bias in the circulated hot air can be reduced by means of the substantially conical distribution member 12. The temperature of the hot air supplied within the treatment chamber 6 is preferably at least 100° C. and not more than 300° C. at the outlet of the hot air supply means 7. If the temperature at the outlet of the hot air supply means 7 is within this range, it is possible to uniformly treat the resin particles while preventing fusion and coalescence of the resin particles due to excessive heating, which is also desirable for improving hot offset resistance.

The heat-treated resin particles are then further cooled by cool air supplied from a cool air supply means 8. The temperature of the cool air supplied from the cool air supply means 8 is preferably at least −20° C. and not more than 30° C. If the temperature of the cool air is within this range, the heat-treated resin particles can be cooled efficiently, and fusion and coalescence of the heat-treated resin particles can be prevented without inhibiting uniform heat treatment of the toner particles. The absolute moisture content of the cool air is preferably at least 0.5 $g/m^3$ and not more than 15.0 $g/m^3$. Subsequently, the cooled heat-treated resin particles are collected by a collection means 10 at the bottom of the treatment chamber 6. A blower (not shown) is provided at the end of the collection means 10 to transport the particles by suction.

The powder particle supply ports 14 are provided in such a way that the circulation direction of the supplied resin particles is the same as the circulation direction of the hot air, and the collection means 10 is also provided in a tangential direction to the outer periphery of the treatment chamber 6 so as to maintain the circulating direction of the circulated resin particles. Moreover, the system is configured so that the cool air supplied from the cool air supply means 8 is supplied horizontally and from a tangential direction from the outer periphery of the device to the inner periphery of the treatment chamber. The circulation direction of the resin particles before heat treatment supplied from the powder particle supply ports 14, the circulation direction of the cool air supplied from the cool air supply means 8 and the circulation direction of the hot air supplied from the hot air supply means 7 are all the same direction. This means that no turbulence occurs within the treatment chamber 6 and the circulating flow within the unit is reinforced so that the resin particles before heat treatment are subjected to strong centrifugal force, further improving the dispersibility of the resin particles before heat treatment and resulting in heat-treated resin particles with a uniform shape and few coalesced particles.

After this, an external additive such as the inorganic fine particle may be added as necessary to obtain a toner.

An external additive may also be added before the heat treatment. In this case, the external additive can be fixed to the surface of the toner particle by heat treatment.

The average circularity of the toner is preferably at least 0.930 and not more than 0.985.

In cases in which the toner particle has been subjected to surface treatment by heat treatment or a surface treatment such as sphering treatment, the average circularity may be at least 0.955 and not more than 0.980. In this case, the transferability and cleaning properties can be improved.

The methods for measuring the various physical properties in the present invention are described next.

<Method for Measuring Molecular Weight and Molecular Weight Distribution of Resin, Etc.>

The molecular weight and molecular weight distribution of the resin and the like are measured as follows by gel permeation chromatography (GPC).

First, a sample is dissolved in tetrahydrofuran (THF) at room temperature over the course of 24 hours. The resulting solution is then filtered with a solvent-resistant membrane filter (Sample Pretreatment Cartridge, Tosoh Corporation) having a pore diameter of 0.2 μm to obtain a sample solution. The concentration of THF-soluble components in the sample solution is adjusted to about 0.8 mass %. Measurement is performed under the following conditions using this sample solution.

System: HLC8120 GPC (detector: RI) (Tosoh Corporation)

Columns: Shodex KF-801, 802, 803, 804, 805, 806, 807 (total 7) (Showa Denko K.K.)

Eluent: Tetrahydrofuran (THF)

Flow rate: 1.0 mL/min

Oven temperature: 40.0° C.

Sample injection volume: 0.10 mL

A molecular weight calibration curve prepared using standard polystyrene resin (trade name TSK standard polystyrene F-850, F-450, F-288, F-128, F-80, F-40, F-20, F-10, F-4, F-2, F-1, A-5000, A-2500, A-1000, A-500, Tosoh Corporation) is used for calculating the molecular weights of the samples.

<Method for Measuring Content of Component a in Toner>

1.0 g of toner is weighed accurately, and dissolved in tetrahydrofuran (THF) at room temperature over the course of 24 hours.

The resulting THF solution is then filtered with a solvent-resistant membrane filter (Sample Pretreatment Cartridge, Tosoh Corporation) having a pore diameter of 0.2 μm to obtain a sample solution.

The resulting sample solution is introduced into the aforementioned GPC system, and a portion having a molecular weight of at least 1,000 and not more than 5,000 is fractionated.

The fractionated solution is dried under reduced pressure to remove the THF, and the resulting solid portion is taken as the component A contained in the toner. The value obtained by multiplying the mass (g) of the resulting component A by 100 is the content (mass %) of the component A in the toner.

<Method for Measuring Mass Ratio of Fatty Acid Metal Salt to Component A>

160 g of sucrose (Kishida Chemical Co., Ltd.) is added to 100 mL of ion-exchange water, and melted with stirring in hot water bath to prepare a sucrose concentrate.

31 g of this sucrose concentrate and 6 mL of Contaminon N (a 10 mass % aqueous solution of a pH 7 neutral detergent for washing precision measurement equipment, comprising a nonionic surfactant, an anionic surfactant and an organic builder, manufactured by Wako Pure Chemical Industries, Ltd.) are placed in a centrifugation tube to prepare a dispersant.

1.0 g of toner is added to this dispersant, and clumps of the toner are broken up with a spatula or the like.

Next, the centrifugation tube is shaken in a shaker. After being shaken, the solution is transferred to a glass tube (50 mL) for a swing rotor, and separated in a centrifuge at 3,500 rpm for 30 minutes. This operation serves to separate the toner particle from the external additives.

Once it has been confirmed by visual observation that the toner and aqueous solution have been thoroughly separated, the toner is collected, filtered with a reduced pressure filter and then dried for at least 1 hour in a drier to obtain a toner particle.

The soluble part other than the fatty acid metal salt contained in the resulting toner particle is then dissolved in toluene or hexane, and the residual amount of the fatty acid metal salt remaining after filtration is measured.

The structure of the residual fatty acid metal salt is determined by nuclear magnetic resonance spectroscopy (NMR), infrared spectroscopy (IR) or fluorescent X-ray.

The mass ratio is then calculated from the resulting mass of the fatty acid metal salt and the mass of the component A as measured by the methods described above.

<Structural Determination of Polyester Resin, Etc.>

The structure of the polyester resin and the like is determined by nuclear magnetic resonance spectroscopy ($^1$H-NMR) [400 MHz, $CDCl_3$, room temperature (25° C.)].

Measurement unit: FT NMR unit JNM-EX400 (JEOL Ltd.)

Measurement frequency: 400 MHz

Pulse condition: 5.0 μs

Frequency range: 10,500 Hz

Cumulative number: 64

<Method for Measuring Number-Average Dispersion Diameter of Fatty Acid Metal Salt>

The number-average dispersion diameter of the fatty acid metal salt in a cross-section of a toner particle observed under a transmission electron microscope (TEM) is measured as follows.

The toner particle is ruthenium stained so that the fatty acid metal salt can be clearly distinguished in a cross-sectional image of the toner particle.

This is because the penetration of the stain material into the fatty acid metal salt produces a stronger stain than that in the other organic components inside the toner particle due to differences in density and the like.

Because the amount of ruthenium atoms differs according to the strength of the stain, more such atoms are present in the strongly stained area, which appears black in the observed image because the electron beam does not pass through it, but the electron beam passes easily through the weakly stained areas, which appear white in the observed image.

The specific procedures are as follows.

An Os film (5 nm) and a naphthalene film (20 nm) are formed as protective films on the toner particle with an Osmium Plasma Coater (OPC80T, Filgen, Inc.).

This is then embedded in D800 photocurable resin (JEOL Ltd.), and a 60 nm-thick toner particle section is prepared at a cutting rate of 1 mm/s with an ultrasonic Ultramicrotome (UC7, Leica Microsystems GmbH).

The resulting section is stained for 15 minutes in $RuO_4$ gas in a 500 Pa atmosphere with a vacuum electronic staining unit (VSC4R1H, Filgen, Inc.) to prepare a sample for observation.

The sample for observation is then photographed with a transmission electron microscope (JEM2800, JEOL Ltd.) to obtain a cross-sectional image of the toner particle.

The probe size of the transmission electron microscope is 1 nm, and the image size is 1,024×1,024 pixels. In cross-sections of 20 randomly-selected toner particles, all of the measurable circle-equivalent diameters of the fatty acid metal salt in particle form are measured, and the average is given as the number-equivalent dispersion diameter (nm) of the fatty acid metal salt.

<Method for Measuring Glass Transition Temperature of Resin>

The glass transition temperature (Tg) of the resin is measured in accordance with ASTM D3418-82, using a Q1000 differential scanning calorimeter (manufactured by TA Instruments).

The melting points of indium and zinc are used for temperature correction of the device detection part, and the heat of fusion of indium is used for correction of the calorific value.

Specifically, 5 mg of the resin is weighed precisely into an aluminum pan, and an empty aluminum pan is used for reference.

Measurement is performed within a temperature range from at least 30° C. to not more than 200° C. at a ramp rate of 10° C./min.

For the measurement, the temperature is first raised from 30° C. to 200° C. and maintained for 10 minutes, then the temperature is lowered from 200° C. to 30° C. at a cooling rate of 10° C./min, and then the temperature is raised again.

A change in specific heat is obtained within the temperature range of 35° C. to 100° C. during this second temperature rise. The temperature at the point of intersection between the differential thermal curve and a line midway between the baselines prior to and subsequent to the appearance of the change in specific heat is taken as the glass transition temperature (Tg) of the resin.

<Method for Measuring Peak Temperatures of Maximum Endothermic Peaks (Melting Points) of Release Agent and Fatty Acid Metal Salt>

The peak temperatures of the maximum endothermic peaks (melting points) of the release agent and fatty acid metal salt are measured in accordance with ASTM D3418-82, using a Q1000 differential scanning calorimeter (manufactured by TA Instruments).

The melting points of indium and zinc are used for temperature correction of the device detection part, and the heat of fusion of indium is used for correction of the calorific value.

Specifically, 10 mg of the resin is weighed precisely into an aluminum pan, and an empty aluminum pan is used for reference.

Measurement is performed within a temperature range from at least 30° C. to not more than 200° C. at a ramp rate of 10° C./min.

The temperature is first raised from 30° C. to 200° C. and then lowered from 200° C. to 30° C. at a cooling rate of 10° C./min, and then the temperature is raised again.

The peak temperature of the maximum endothermic peak in the differential thermal curve in the temperature range from at least 30° C. to not more than 200° C. during this second temperature rise is given as the melting point of the sample.

<Method for Measuring BET Specific Surface Area of Inorganic Fine Particle>

The BET specific surface area of the inorganic fine particle is measured in accordance with JIS Z8830 (2001).

Using a Tristar 3000 (Shimadzu Corporation) automatic specific surface area/pore distribution measurement device using a measurement system based on constant-volume gas adsorption, the measurement conditions are set and the measurement data are analyzed using the dedicated software (TriStar 3000 Version 4.00) attached to the device. Calculation is done by the BET multipoint method using nitrogen gas as the adsorption gas.

<Method for Measuring Weight-Average Particle Diameter (D4) of Toner>

The weight-average particle diameter (D4) of the toner is measured using a Coulter Counter Multisizer 3 (registered trademark, Beckman Coulter, Inc.) precision particle size distribution measurement device based on the pore electrical resistance method and equipped with a 100 μm aperture tube. Beckman Coulter Multisizer 3 Version 3.51 dedicated software (Beckman Coulter, Inc.) attached to the device is used to set the measurement conditions and analyze the measurement data. Measurement is performed with 25,000 effective measurement channels, and the measurement data are analyzed to calculate the particle diameter.

A solution of special-grade sodium chloride dissolved to a concentration of about 1 mass % in ion-exchange water, such as "Isoton II" (Beckman Coulter, Inc.), may be used as the electrolytic solution for measurement.

The following settings are performed on the dedicated software prior to measurement and analysis.

On the "Change Standard Operating Method (SOM)" screen of the dedicated software, the total count in control mode is set to 50,000 particles, the number of measurements to one, and the Kd value to a value obtained using "Standard Particles 10.0 μm" (Beckman Coulter, Inc.). The threshold and noise level are set automatically by pressing the threshold/noise level measurement button. The current is set to 1,600 μA, the gain to 2, and the electrolytic solution to Isoton II, and a check is entered for aperture tube flush after measurement.

On the "Conversion Setting from Pulse to Particle Diameter" screen of the dedicated software, the bin interval is set to the logarithmic particle diameter, the particle diameter bin is set to the 256 particle diameter bin, and the particle diameter range is set to at least 2 μm and not more than 60 μm.

The specific measurement methods are (1) to (7) below.

(1) About 200 mL of the aqueous electrolytic solution is placed in a 250 mL glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the dedicated software.

(2) Approximately 30 mL of the aqueous electrolytic solution is placed in a 100 mL glass flat-bottom beaker, and approximately 0.3 mL of a diluted solution of "Contaminon N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted 3 times by mass with ion exchange water is added thereto as a dispersant.

(3) A predetermined amount of ion-exchange water is placed in the water bath of an "Ultrasonic Dispersion System Tetora 150" (Nikkaki Bios Co., Ltd.) ultrasonic disperser with an electric output of 120 W in which two oscillators with an oscillation frequency of 50 kHz are built-in with the phases of the oscillators shifted by 180° to one other, and about 2 mL of the Contaminon N is added to the water bath.

(4) The beaker of (2) is set in a beaker-fixing hole of the ultrasonic disperser, and the ultrasonic disperser is operated. The height position of the beaker is adjusted so as to maximize the resonance state of the surface of the electrolytic solution in the beaker.

(5) The electrolytic solution in the beaker of (4) exposed to ultrasonic waves as approximately 10 mg of the toner is added little by little to the electrolytic solution and dispersed. Ultrasonic dispersion treatment is then continued for a further 60 seconds. During the ultrasonic dispersion, the temperature of the water in the water bath is adjusted as necessary so as to be at least 10° C. and not more than 40° C.

(6) Using a pipette, the electrolytic solution of (5) with the toner dispersed therein is added dropwise to the round-bottom beaker of (1) disposed on the sample stand, and the measurement concentration is adjusted to about 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the analysis/volume statistical value (arithmetic average) screen when graph/volume % is set by the dedicated software.

<Method for Measuring Average Circularity of Toner>

The average circularity of the toner can be measured under the measurement and analysis conditions for calibration operations, using an FPIA-3000 flow-type particle image analyzer (Sysmex Corporation).

The specific measurement methods are as follows.

First, about 20 mL of ion-exchange water from which solid impurities and the like have been removed in advance is placed in a glass container. About 0.2 mL of a diluted solution of "Contaminon N" diluted about 3 times by mass with ion-exchange water is then added thereto as a dispersant. About 0.02 g of the measurement sample is then added, and dispersed for 2 minutes with an ultrasonic disperser to obtain a dispersion for measurement. During this process, cooling is performed appropriately so that the temperature of the dispersion be at least 10° C. and not more than 40° C.

Using a tabletop ultrasonic washer and disperser with an oscillation frequency of 50 kHz and an electrical output of 150 W (such as VS-150, made by Velvo-Clear) as the ultrasonic disperser, a predetermined amount of ion-exchange water is placed in the water bath, and about 2 mL of Contaminon N is added to this water bath.

A flow type particle image analyzer equipped with a standard objective lens (10×) is used for measurement, and particle sheath (PSE-900A, Sysmex Corporation) is used as the sheath liquid.

A dispersion prepared by the procedures described above is introduced into the flow type particle image analyzer, and 3,000 toner particles are measured in HPF measurement mode and in total count mode.

The average circularity of the toner is determined with the binarization threshold set to 85% during particle analysis, taking circle-equivalent diameters of at least 1.98 μm and not more than 39.96 μm.

<Method for Measuring Acid Value of Resin>

The acid value is the number of mg of potassium hydroxide needed to neutralize the acid contained in 1 g of sample.

Measurement is performed in accordance with JIS K 0070-1992, and the specific procedures are as follows.

(1) Sample Preparation 1.0 g of phenolphthalein is dissolved in 90 mL of ethyl alcohol (95 volume %), and ion-exchange water is added to a total of 100 mL to obtain a phenolphthalein solution.

7 g of special-grade potassium hydroxide is dissolved in 5 mL of water, and ethyl alcohol (95 volume %) is added to a total of 1 L. Taking care to avoid contact with carbon dioxide and the like, this is placed in an alkali-resistant container, left standing for 3 days, and filtered to obtain a potassium hydroxide solution. The resulting potassium hydroxide solution is stored in an alkali-resistant container.

The factor of the potassium hydroxide solution is obtained by placing 25 mL of 0.1 mol/L hydrochloric acid in a triangular flask, adding several drops of the phenolphthalein solution, titrating this with the potassium hydroxide solution, and determining the amount of the potassium hydroxide solution required for neutralization. The 0.1 mol/L hydrochloric acid is prepared previously in accordance with JIS K 8001-1998.

(2) Operations (A) Main Test 2.0 g of sample is weighed precisely into a 200 mL triangular flask, 100 mL of a toluene/ethanol (2:1) mixed solution is added, and the sample is dissolved over the course of 5 hours. Several drops of the phenolphthalein solution are then added as an indicator, and this is titrated with the potassium hydroxide solution. Titration is considered to be complete when the light pink color of the indicator persists for 30 seconds.

(B) Blank Test

Titration is performed by the same operations but without a sample (that is, using only a mixed toluene/ethanol (2:1) solution).

(3) The results are entered into the following formula to calculate the acid value.

$$A=[(C-B)\times f\times 5.61]/S$$

Where, A is the acid value (mg KOH/g), B is the added amount (ml) of the potassium hydroxide solution in the blank test, C is the added amount (ml) of the potassium hydroxide solution in the main test, f is the factor of the potassium hydroxide solution, and S is the sample (g).

<Method for Measuring Softening Point (Tm)>

The softening point of the resin and the like is measured using a constant load extrusion-type capillary rheometer (Flow Tester CFT-500D flow characteristics evaluation device, Shimadzu Corporation) in accordance with the attached manual.

With this device, the temperature of a measurement sample packed in a cylinder is raised to melt the sample while a fixed load is applied with a piston from the top of the measurement sample, the melted measurement sample is extruded from a die at the bottom of the cylinder, and a flow curve can then be obtained showing the relationship between the temperature and the amount of descent of the piston during this process.

The softening point in the present invention is the "melting temperature by the ½ method" as described in the manual attached to the Flow Tester CFT-500D flow characteristics evaluation device.

The melting temperature by the ½ method is calculated as follows.

First, ½ the difference between the descent of the piston upon completion of outflow (Smax) and the descent of the piston at the beginning of outflow (Smin) is calculated and given as X (X=(Smax−Smin)/2). The temperature in the flow curve at which the descent of the piston is the sum of X and Smin is the melting point by the ½ method.

For the measurement sample, about 1.0 g of the resin is compression molded for about 60 seconds at about 10 MPa in a 25° C. environment with a tablet molding compressor (for example NT-100H, manufactured by NPA Systems) to obtain a cylinder about 8 mm in diameter.

The CFT-500D measurement conditions are as follows.

Test mode: Temperature rising method
Initial temperature: 50° C.
Achieved temperature: 200° C.
Measurement interval: 1.0° C.
Ramp rate: 4.0° C./min
Piston cross-sectional area: 1.000 $cm^2$
Test load (piston load): 10.0 kgf (0.9807 MPa)
Preheating time: 300 seconds
Die hole diameter: 1.0 mm
Die length: 1.0 mm

EXAMPLES

The present invention is explained in detail below using examples, but the present invention is not limited thereby. Unless otherwise specified, parts and percentages in the examples are based on mass.

<Manufacturing Example of Polyester Resin (L1)>

Polyoxypropylene(2.2)-2,2-bis(4-hydroxyphenyl)propane: 75.0 parts (0.19 moles; 100 mol % of total moles of alcohol component)
Terephthalic acid: 23.3 parts (0.14 moles; 91 mol % of total moles of carboxylic acid component)
Succinic acid: 1.7 parts (0.01 moles; 9 mol % of total moles of carboxylic acid component)
Di(2-ethylhexylic acid)tin (1.0 mass % of total amount of monomers)

These materials were weighed into a reaction tank equipped with a cooling tube, a stirrer, a nitrogen introduction tube and a thermocouple.

Next, nitrogen gas was substituted inside the reaction tank, the temperature was gradually raised with stirring, and the mixture was reacted for 5 hours with stirring at 200° C. (first reaction step) to obtain a polyester resin (L1).

The resulting polyester resin (L1) had a peak molecular weight (Mp) of 4,700, and an acid value of 7 mg KOH/g.

Manufacturing Example of Polyester Resin (L2)

Polyoxypropylene(2.2)-2,2-bis(4-hydroxyphenyl)propane: 75.0 parts (0.19 moles; 100 mol % of total moles of alcohol component)
Terephthalic acid: 23.2 parts (0.14 moles; 96 mol % of total moles of carboxylic acid component)
Titanium tetrabutoxide: 0.5 part These materials were weighed into a reaction tank equipped with a cooling tube, a stirrer, a nitrogen introduction tube and a thermocouple.

Next, nitrogen gas was substituted inside the reaction tank, the temperature was gradually raised with stirring, and the mixture was reacted for 4 hours with stirring at 200° C. (first reaction step).

The pressure inside the reaction tank was then lowered to 8.3 kPa and maintained for 1 hour, after which the system was cooled to 180° C., and the pressure was returned to atmospheric pressure.

Trimellitic anhydride: 1.2 parts (0.01 moles; 4 mol % of total moles of carboxylic acid component)

The above material was then added, the pressure inside the reaction tank was lowered to 8.3 kPa, and the mixture was reacted for 1 hour with the temperature maintained at 180° C. (second reaction step) to obtain a polyester resin (L2).

The resulting polyester resin (L2) had a peak molecular weight (Mp) of 4700, and an acid value of 7 mg KOH/g.

<Manufacturing Examples of Polyester Resins (L3) to (L12)>

Polyester resins (L3) to (L12) were obtained by the same reactions as in the manufacturing example of the polyester resin (L1) except that the alcohol component and carboxylic acid component and their molar ratios were changed as shown in Table 1.

The mass parts of the raw materials were adjusted so that the total moles of the alcohol components and carboxylic acid components were the same as in the manufacturing example of the polyester resin (L1). The physical properties of the resulting polyester resins (L3) to (L12) are shown in Table 1.

<Manufacturing Example of Polyester Resin H1>

Polyoxypropylene(2.2)-2,2-bis(4-hydroxyphenyl)propane: 73.4 parts (0.19 moles; 100 mol % of total moles of alcohol component)

Terephthalic acid: 24.2 parts (0.15 moles; 82 mol % of total moles of carboxylic acid component)

Adipic acid: 1.2 parts (0.01 moles; 14 mol % of total moles of carboxylic acid component)

Di(2-ethylhexylic acid)tin: 0.5 part

These materials were weighed into a reaction tank equipped with a cooling tube, a stirrer, a nitrogen introduction tube and a thermocouple.

Next, nitrogen gas was substituted inside the reaction tank, the temperature was gradually raised with stirring, and the mixture was reacted for 2 hours with stirring at 200° C. (first reaction step).

The pressure inside the reaction tank was then lowered to 8.3 kPa, and maintained for 1 hour, after which the system was cooled to 160° C. and the pressure was returned to atmospheric pressure.

Trimellitic anhydride: 1.2 parts (0.01 moles; 4 mol % of total moles of carboxylic acid component)

Tert-butylcatechol (polymerization inhibitor): 0.1 part

The above materials were then added, the pressure inside the reaction tank was lowered to 8.3 kPa, the mixture was reacted for 15 hours with the temperature maintained at 160° C. (second reaction step), and the temperature was lowered to stop the reaction and obtain a polyester resin (H1).

The resulting polyester resin (H1) had a peak molecular weight (Mp) of 11,000 and an acid value of 25 mg KOH/g.

<Manufacturing Example of Polyester Resin (H2)>

Polyoxypropylene(2.2)-2,2-bis(4-hydroxyphenyl)propane: 71.8 parts (0.20 moles; 100 mol % of total moles of alcohol component)

Terephthalic acid: 15.0 parts (0.09 moles; 55 mol % of total moles of carboxylic acid component)

Adipic acid: 5.7 parts (0.04 moles; 25 mol % of total moles of carboxylic acid component)

Titanium tetrabutoxide 0.5 part

These materials were weighed into a reaction tank equipped with a cooling tube, a stirrer, a nitrogen introduction tube and a thermocouple.

Next, nitrogen gas was substituted inside the reaction tank, the temperature was gradually raised with stirring, and the mixture was reacted for 2 hours with stirring at 200° C. (first reaction step).

The pressure inside the reaction tank was then lowered to 8.3 kPa, and maintained for 2 hours, after which the system was cooled to 160° C., and the pressure was returned to atmospheric pressure.

Trimellitic anhydride 7.5 parts (0.04 moles; 20 mol % of total moles of carboxylic acid component)

The above material was then added, the pressure inside the reaction tank was lowered to 8.3 kPa, the mixture was reacted for 15 hours with the temperature maintained at 160° C. (second reaction step), and the temperature was then lowered to stop the reaction and to obtain a polyester resin (H2).

The resulting polyester resin (H2) had a peak molecular weight (Mp) of 11,000 and an acid value of 25 mg KOH/g.

TABLE 1

| Polyester resin | BPA-PO (2.2) (mol %) | BPA-EO (2.2) (mol %) | EG (mol %) | TPA (mol %) | TA (mol %) | SA (mol %) | AA (mol %) | Mp | Acid value (mg KOH/g) | First reaction step (h) | Second reaction step (h) |
|---|---|---|---|---|---|---|---|---|---|---|---|
| L1 | 100 | 0 | 0 | 91 | 0 | 9 | 0 | 4700 | 7 | 5 | 0 |
| L2 | 100 | 0 | 0 | 96 | 4 | 0 | 0 | 4700 | 7 | 4 | 1 |
| L3 | 100 | 0 | 0 | 93 | 0 | 7 | 0 | 5500 | 6 | 5 | 0 |
| L4 | 100 | 0 | 0 | 89 | 0 | 11 | 0 | 4100 | 8 | 5 | 0 |
| L5 | 100 | 0 | 0 | 95 | 0 | 5 | 0 | 5900 | 6 | 5 | 0 |
| L6 | 100 | 0 | 0 | 87 | 0 | 13 | 0 | 3900 | 10 | 5 | 0 |
| L7 | 100 | 0 | 0 | 91 | 0 | 9 | 0 | 6100 | 1 | 6 | 0 |
| L8 | 100 | 0 | 0 | 91 | 0 | 9 | 0 | 4800 | 30 | 3 | 0 |
| L9 | 0 | 100 | 0 | 93 | 0 | 7 | 0 | 7000 | 50 | 6 | 0 |
| L10 | 0 | 100 | 0 | 89 | 0 | 11 | 0 | 3000 | 50 | 4 | 0 |
| L11 | 90 | 0 | 10 | 95 | 0 | 5 | 0 | 7500 | 50 | 6 | 0 |
| L12 | 90 | 0 | 10 | 80 | 0 | 20 | 0 | 2500 | 50 | 6 | 0 |
| H1 | 100 | 0 | 0 | 82 | 4 | 0 | 14 | 11000 | 25 | 2 | 15 |
| H2 | 100 | 0 | 0 | 55 | 20 | 0 | 25 | 11000 | 25 | 2 | 15 |

In the Table 1,

BPA-PO(2.2) represents polyoxypropylene(2.2)-2,2-bis(4-hydroxyphenyl)propane,

BPA-EO(2.2) represents polyoxyethylene(2.2)-2,2-bis(4-hydroxyphenyl)propane,

EG represents ethylene glycol, TPA represents terephthalic acid,

TA represents trimellitic anhydride,

SA represents succinic acid and

AA represents adipic acid.

<Manufacturing Example of Vinyl Resin (V1)>

50 parts of xylene were loaded into an autoclave, which was then purged with nitrogen, and the temperature was raised to 185° C. with stirring in a sealed condition.

A mixed solution of 95 parts of styrene, 5 parts of n-butyl acrylate, 5 parts of di-t-butyl peroxide and 20 parts of xylene was added dropwise continuously for 3 hours with the internal temperature of the autoclave controlled at 185° C., and polymerized.

The same temperature was maintained for 1 hour to complete polymerization, and the solvent was removed to obtain a vinyl resin (V1). The resulting vinyl resin (V1) had a peak molecular weight (Mp) of 4,500, a softening point (Tm) of 96° C. and a glass transition temperature (Tg) of 58° C.

<Manufacturing Example of Toner 1>

| | |
|---|---|
| Polyester resin (L1) | 75.0 parts |
| Polyester resin (H1) | 25.0 parts |
| Vinyl resin (V1) | 5.0 parts |
| Fischer-Tropsch wax | 5.0 parts |

(maximum endothermic peak temperature (melting point): 90° C.)

| | |
|---|---|
| C.I. Pigment Blue 15:3 | 5.0 parts |
| Magnesium distearate | 0.5 part |

(maximum endothermic peak temperature (melting point): 145° C.)

These materials were mixed at a rotational speed of 20 $s^{-1}$ for a rotation time of 5 minutes with a HENSCHEL MIXER (FM-75, Nippon Coke & Engineering Co., Ltd.). The temperature was then set at 120° C., and the mixture was kneaded with a twin-screw kneader (PCM-30, Ikegai Corp.) at a discharge temperature of 130° C. The resulting kneaded material was cooled, and coarsely pulverized to 1 mm or less with a hammer mill to obtain a coarsely pulverized product.

The resulting coarsely pulverized product was finely pulverized with a mechanical pulverizer (T-250, Freund Turbo Co., Ltd.). It was then classified with a Faculty F-300 (Hosokawa Micron Corporation) to obtain a toner particle 1. The operating conditions were a classifying rotor speed of 130 $s^{-1}$ and a dispersing rotor speed of 120 $s^{-1}$.

The resulting toner particle 1 was heat treated with the apparatus shown in the FIGURE to obtain a heat-treated toner particle. The operating conditions were a feed rate of 5 kg/hr, a hot air temperature of 160° C., a hot air flow rate of 6 $m^3$/min, a cool air temperature of −5° C., a cool air flow rate of 4 $m^3$/min, a blower volume of 20 $m^3$/min, and an injection air volume of 1 $m^3$/min.

1.0 parts of a hydrophobic silica fine particle with a BET specific surface area of 25 $m^2$/g that had been surface treated with 4 mass % hexamethyl disilazane and 0.8 parts of a hydrophobic silica fine particle with a BET specific surface area of 100 $m^2$/g that had been surface treated with 10 mass % polydimethylsiloxane were added to 100 parts of the resulting heat-treated toner particle, and then mixed at a rotational speed of 30 $s^{-1}$ for a rotation time of 10 minutes with a HENSCHEL MIXER (FM-75, Nippon Coke & Engineering Co., Ltd.) to obtain a Toner 1.

The Toner 1 had a weight-average particle diameter (D4) of 6.4 μm, and an average circularity of 0.963. The content of the component A was 68 mass %. The mass ratio of magnesium distearate relative to the component A was 0.007. The average dispersion diameter of the magnesium distearate was confirmed to be 100 nm. The various physical properties are shown in Table 2.

<Manufacturing Example of Toner 2>

(Preparation of Polyester Resin (L1) Particle Dispersion)

A mixed solvent consisting of 250 parts of ethyl acetate and 50 parts of isopropyl alcohol was added to a 5 L separable flask, 200 parts of the polyester resin (L1) were gradually added thereto, and this was stirred with a Three One Motor (Shinto Scientific Co., Ltd.) to dissolve the mixture and obtain an oil phase.

A suitable amount of a dilute aqueous ammonia solution was added dropwise to the oil phase under stirring, and 1,000 parts of ion-exchange water were added dropwise to perform phase-inversion emulsification, after which the solvent was removed under reduced pressure in an evaporator to obtain a polyester resin (L1) particle dispersion.

(Preparation of Polyester Resin (H1) Particle Dispersion)

A polyester resin (H1) particle dispersion was prepared in the same way as the polyester resin (L1) particle dispersion except that the polyester resin (H1) was substituted for the polyester resin (L1).

(Preparation of Vinyl Resin (V1) Particle Dispersion)

A vinyl resin (V1) particle dispersion was prepared in the same way as the polyester resin (L1) particle dispersion except that the vinyl resin (V1) was substituted for the polyester resin (L1).

(Preparation of Wax Dispersion)

| | |
|---|---|
| Ion-exchange water | 800 parts |
| Fischer-Tropsch wax (maximum endothermic peak temperature (melting point): 90° C.) | 200 parts |
| Anionic surfactant (Neogen RK, DKS Co. Ltd.) | 10 parts |

These were heated to 95° C., thoroughly dispersed with an Ultra-turrax T50 (IKA-Werke GmbH & Co. KG), and then dispersed with a pressure discharge-type homogenizer to obtain a wax dispersion with a solids content of 20 mass %.

(Preparation of Colorant Particle Dispersion)

| | |
|---|---|
| C.I. Pigment Blue 15:3 | 100 parts |
| Sodium dodecyl benzene sulfonate | 5 parts |
| Ion-exchange water | 400 parts |

These were mixed and dispersed with a sand grinder mill to obtain a colorant particle dispersion.

(Preparation of Calcium Dilaurate Dispersion)

| | |
|---|---|
| Ion-exchange water | 800 parts |
| Calcium dilaurate (maximum endothermic peak temperature (melting point): 165° C.) | 200 parts |
| Anionic surfactant (Neogen RK, DKS Co. Ltd.) | 10 parts |

These were heated to 200° C., thoroughly dispersed with an Ultra-turrax T50 (IKA-Werke GmbH & Co. KG), and then dispersed with a pressure discharge-type homogenizer to obtain a calcium dilaurate dispersion with a solids content of 20 mass %.

| | |
|---|---|
| Polyester resin (L1) particle dispersion | 750 parts |
| Polyester resin (H1) particle dispersion | 250 parts |

-continued

| | |
|---|---|
| Vinyl resin (V1) particle dispersion | 50 parts |
| Colorant particle dispersion | 42 parts |
| Wax dispersion | 42 parts |
| Calcium dilaurate dispersion | 4.2 parts |
| Sodium dodecyl benzene sulfonate | 5 parts |

The polyester resin (L1) particle dispersion, polyester resin (H1) particle dispersion, vinyl resin (V1) particle dispersion, wax dispersion and sodium dodecyl benzene sulfonate were loaded into a reactor (1 liter volume flask, anchor blade with baffle), and uniformly mixed.

Meanwhile the colorant particle dispersion was placed in a 500 mL beaker, and stirred while being gradually added to the reactor to obtain a mixed dispersion. The resulting mixed dispersion was stirred as 0.5 parts (as solids) of an aluminum sulfate aqueous solution were added dropwise to form aggregated particles.

After completion of dropping, nitrogen was substituted inside the system, which was then maintained for 1 hour at 50° C. and for 1 hour at 55° C.

The temperature was then raised and held at 90° C. for 30 minutes. The temperature was then lowered to 63° C. and maintained for 3 hours to form fused particles. The reaction in this case was performed in a nitrogen atmosphere. After a specific period of time, this was cooled to room temperature at a rate of 0.5° C. per minute.

After being cooled, the reaction product was subjected to solid-liquid separation under 0.4 MPa of pressure in a 10 L volume pressure filter unit to obtain a toner cake.

Ion-exchange water was then added until the pressure filter unit was full, and the operation of solid-liquid separation was performed three times at 0.4 MPa to wash the toner cake.

The resulting toner cake was dispersed in 1 L of a mixed 50:50 methanol/water solvent in which 0.15 parts of a nonionic surfactant had been previously dispersed, to obtain a surface-treated toner particle dispersion.

This toner particle dispersion was placed in a pressure filter unit, and a further 5 L of ion-exchange water was added. This was subjected to solid-liquid separation under 0.4 MPa of pressure, followed by fluid bed drying at 45° C. to obtain a toner particle 2.

1.0 parts of a hydrophobic silica fine particle with a BET specific surface area of 25 $m^2/g$ that had been surface treated with 4 mass % of hexamethyl disilazane and 0.8 parts of a hydrophobic silica fine particle with a BET specific surface area of 100 $m^2/g$ that had been surface treated with 10 mass % of polydimethylsiloxane were added to 100 parts of the toner particle 2, and then mixed at a rotational speed of 30 $s^{-1}$ for a rotation time of 10 minutes with a HENSCHEL MIXER (FM-75, Nippon Coke & Engineering Co., Ltd.) to obtain a Toner 2.

The Toner 2 had a weight-average particle diameter (D4) of 6.3 μm, and an average circularity of 0.956. The content of the component A was 68 mass %. The mass ratio of the calcium dilaurate relative to the component A was 0.007. The average dispersion diameter of the calcium dilaurate was also confirmed to be 250 nm. The various physical properties are shown in Table 2.

<Manufacturing Example of Toner 3>

(Preparation of Magnesium Distearate Dispersion)

| | |
|---|---|
| Polyester resin (L2) | 75.5 parts |
| Magnesium distearate (maximum endothermic peak temperature (melting point): 145° C.) | 0.5 part |

These materials were mixed at a rotational speed of 20 $s^{-1}$ for a rotation time of 5 minutes with a HENSCHEL MIXER (FM-75, Nippon Coke & Engineering Co., Ltd.). The temperature was then set at 120° C., and the mixture was kneaded with a twin-screw kneader (PCM-30, Ikegai Corp.) at a discharge temperature of 130° C. The resulting kneaded material was cooled, and coarsely pulverized to 1 mm or less with a hammer mill to obtain a magnesium distearate dispersion.

| | |
|---|---|
| Magnesium distearate dispersion | 75.5 parts |
| Polyester resin (H1) | 25.0 parts |
| Vinyl resin (V1) | 5.0 parts |
| Fischer-Tropsch wax (maximum endothermic peak temperature (melting point): 90° C.) | 5.0 parts |
| C.I. Pigment Blue 15:3 | 5.0 parts |

These materials were mixed at a rotational speed of 20 $s^{-1}$ for a rotation time of 5 minutes with a HENSCHEL MIXER (FM-75, Nippon Coke & Engineering Co., Ltd.). The temperature was then set at 120° C., and the mixture was kneaded with a twin-screw kneader (PCM-30, Ikegai Corp.) at a discharge temperature of 130° C. The resulting kneaded material was cooled, and coarsely pulverized to 1 mm or less with a hammer mill to obtain a coarsely pulverized product.

The resulting coarsely pulverized product was finely pulverized with a mechanical pulverizer (T-250, Freund Turbo Co., Ltd.). It was then classified with a Faculty F-300 (Hosokawa Micron Corporation) to obtain a toner particle 3. The operating conditions were a classifying rotor speed of 130 $s^{-1}$ and a dispersing rotor speed of 120 $s^{-1}$.

1.0 part of a hydrophobic silica fine particle with a BET specific surface area of 25 $m^2/g$ that had been surface treated with 4 mass % of hexamethyl disilazane and 0.8 parts of a hydrophobic silica fine particle with a BET specific surface area of 100 $m^2/g$ that had been surface treated with 10 mass % of polydimethylsiloxane were added to 100 parts of the toner particle 3, and then mixed at a rotational speed of 30 $s^{-1}$ for a rotation time of 10 minutes with a HENSCHEL MIXER (FM-75, Nippon Coke & Engineering Co., Ltd.) to obtain a Toner 3.

The Toner 3 had a weight-average particle diameter (D4) of 6.5 μm, and an average circularity of 0.951. The content of the component A was 68 mass %. The mass ratio of the magnesium distearate relative to the component A was 0.007. The average dispersion diameter of the magnesium distearate was also confirmed to be 100 nm. The physical properties are shown in Table 2.

<Manufacturing Examples of Toners 4 to 22>

Toners 4 to 22 were obtained as in the manufacturing example of Toner 1 except that no heat treatment was performed, and the formulations were changed as shown in Table 2. The various physical properties are shown in Table 2.

TABLE 2

| | Formulation | | | | | | | | | |
|---|---|---|---|---|---|---|---|---|---|---|
| | | | | | | | Wax | | | |
| | Resin 1 | | Resin 2 | | Resin 3 | | | Melting | | |
| Toner No. | Type | Content (parts) | Type | Content (parts) | Type | Content (parts) | Type | point (° C.) | Content (parts) | Fatty acid metal salt Type |
| 1 | L1 | 75.0 | H1 | 25.0 | V1 | 5.0 | W1 | 90 | 5.0 | Magnesium distearate |
| 2 | L1 | 75.0 | H1 | 25.0 | V1 | 5.0 | W1 | 90 | 5.0 | Calcium dilaurate |
| 3 | L2 | 75.0 | H1 | 25.0 | V1 | 5.0 | W1 | 90 | 5.0 | Magnesium distearate |
| 4 | L1 | 75.0 | H1 | 25.0 | V1 | 5.0 | W1 | 90 | 5.0 | Zinc distearate |
| 5 | L1 | 72.0 | H1 | 28.0 | V1 | 5.0 | W1 | 90 | 5.0 | Aluminum monostearate |
| 6 | L3 | 70.0 | H1 | 30.0 | V1 | 5.0 | W1 | 90 | 5.0 | Calcium distearate/ zinc distearate (1/1) |
| 7 | L4 | 65.0 | H1 | 35.0 | V1 | 5.0 | W1 | 90 | 5.0 | Magnesium di-1,2-hydroxystearate |
| 8 | L5 | 60.0 | H1 | 40.0 | V1 | 5.0 | W1 | 90 | 5.0 | Aluminum dimontanate |
| 9 | L6 | 55.0 | H1 | 45.0 | V1 | 5.0 | W1 | 90 | 5.0 | Barium dilaurate |
| 10 | L6 | 55.0 | H1 | 45.0 | V1 | 5.0 | W1 | 90 | 5.0 | Lithium stearate |
| 11 | L6 | 55.0 | H1 | 45.0 | V1 | 5.0 | W1 | 90 | 5.0 | Lithium stearate |
| 12 | L7 | 50.0 | H1 | 50.0 | V1 | 5.0 | W1 | 90 | 5.0 | Lithium stearate |
| 13 | L8 | 45.0 | H1 | 55.0 | V1 | 5.0 | W1 | 90 | 5.0 | Barium distearate |
| 14 | L9 | 83.0 | H1 | 17.0 | V1 | 5.0 | W1 | 90 | 5.0 | Barium distearate |
| 15 | L10 | 40.0 | H1 | 60.0 | V1 | 5.0 | W1 | 90 | 5.0 | Barium distearate |
| 16 | L11 | 40.0 | H1 | 60.0 | V1 | 5.0 | W1 | 90 | 5.0 | Barium distearate |
| 17 | L11 | 30.0 | H1 | 70.0 | V1 | 5.0 | W1 | 90 | 5.0 | Barium distearate |
| 18 | L12 | 90.0 | H1 | 10.0 | V1 | 5.0 | W2 | 110 | 5.0 | Barium distearate |
| 19 | L1 | 70.0 | H1 | 30.0 | V1 | 5.0 | W1 | 90 | 5.0 | — |
| 20 | L1 | 23.0 | H1 | 77.0 | V1 | 5.0 | W1 | 90 | 5.0 | Magnesium distearate |
| 21 | L1 | 94.0 | H1 | 6.0 | V1 | 5.0 | W1 | 90 | 5.0 | Magnesium distearate |
| 22 | L1 | 75.0 | H1 | 25.0 | V1 | 5.0 | W1 | 90 | 5.0 | Magnesium distearate |

| | Formulation | | | | | | | | |
|---|---|---|---|---|---|---|---|---|---|
| | Fatty acid metal salt | | | | | | | | |
| Toner No. | Melting point (° C.) | Content (parts) | Number average dispersion diameter (nm) | Average circularity | D4 (μm) | Content of component A (mass %) | Fatty acid metal salt Component/ A | Manufacturing method method | Heat treatment |
| 1 | 145 | 0.5 | 100 | 0.963 | 6.4 | 68 | 0.007 | P1 | Implemented |
| 2 | 165 | 0.5 | 250 | 0.956 | 6.3 | 68 | 0.007 | P2 | Not implemented |
| 3 | 145 | 0.5 | 100 | 0.951 | 6.5 | 68 | 0.007 | P1 | Not implemented |
| 4 | 125 | 1.0 | 150 | 0.955 | 6.1 | 68 | 0.013 | P1 | Not implemented |
| 5 | 150 | 1.0 | 200 | 0.953 | 6.7 | 65 | 0.013 | P1 | Not implemented |
| 6 | 155 | 1.0 | 170 | 0.953 | 6.2 | 63 | 0.014 | P1 | Not implemented |
| 7 | 140 | 1.0 | 220 | 0.955 | 6.6 | 59 | 0.015 | P1 | Not implemented |
| 8 | 180 | 1.0 | 140 | 0.951 | 6.3 | 54 | 0.017 | P1 | Not implemented |
| 9 | 195 | 1.0 | 160 | 0.957 | 6.5 | 50 | 0.018 | P1 | Not implemented |
| 10 | 220 | 0.3 | 70 | 0.959 | 6.4 | 50 | 0.005 | P1 | Not implemented |
| 11 | 220 | 2.0 | 450 | 0.958 | 5.9 | 49 | 0.036 | P1 | Not implemented |
| 12 | 220 | 0.3 | 50 | 0.958 | 6.4 | 45 | 0.006 | P1 | Not implemented |
| 13 | 225 | 1.5 | 500 | 0.959 | 6.5 | 40 | 0.038 | P1 | Not implemented |
| 14 | 225 | 2.0 | 550 | 0.957 | 6.3 | 74 | 0.024 | P1 | Not implemented |
| 15 | 225 | 2.0 | 520 | 0.951 | 6.2 | 36 | 0.033 | P1 | Not implemented |
| 16 | 225 | 2.0 | 510 | 0.954 | 6.6 | 36 | 0.033 | P1 | Not implemented |
| 17 | 225 | 0.1 | 510 | 0.949 | 5.8 | 27 | 0.033 | P1 | Not implemented |

TABLE 2-continued

| | | | | | | | | | |
|---|---|---|---|---|---|---|---|---|---|
| 18 | 225 | 5.0 | 570 | 0.953 | 6.5 | 78 | 0.056 | P1 | Not implemented |
| 19 | — | 0.0 | — | 0.951 | 6.4 | 64 | 0.000 | P1 | Not implemented |
| 20 | 145 | 0.5 | 100 | 0.953 | 6.2 | 21 | 0.022 | P1 | Not implemented |
| 21 | 145 | 0.5 | 100 | 0.953 | 6.2 | 85 | 0.005 | P1 | Not implemented |
| 22 | 145 | 0.5 | 100 | 0.953 | 6.2 | 65 | 0.067 | P1 | Not implemented |

In Table 2,

W1 represents Fischer-Tropsch wax,

W2 represents ester wax (maximum endothermic peak temperature (melting point): 110° C.), P1 represents the melt kneading method, and P2 represents the emulsion aggregation method.

<Manufacturing Example of Magnetic Carrier 1>

(Manufacturing Example of Magnetic Core Particle 1)

| Step 1 (Weighing and Mixing Step): | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

The ferrite raw materials were weighed to obtain the above compositional ratio of the materials. This was then pulverized and mixed for 5 hours in a dry vibration mill using stainless beads ⅛ inch in diameter.

Step 2 (Pre-Baking Step):

The resulting pulverized product was made into roughly 1 mm-square pellets in a roller compacter. These pellets were passed through a 3 mm mesh vibrating screen to remove coarse powder, and then passed through an 0.5 mm mesh vibrating screen to remove fine powder, after which they were baked for 4 hours at 1,000° C. in a nitrogen atmosphere (oxygen concentration 0.01 volume %) in a burner-type furnace to prepare a pre-baked ferrite. The composition of the resulting pre-baked ferrite is as follows.

$$(MnO)_a(MgO)_b(SrO)_c(Fe_2O_3)_d.$$

In the formula, a=0.257, b=0.117, c=0.007 and d=0.393.

Step 3 (Pulverization Step):

The pre-baked ferrite was crushed in a crusher to about 0.3 mm, after which 30 parts of water were added to 100 parts of the pre-baked ferrite, which was pulverized for 1 hour in a wet ball mill with zirconia beads ⅛ inch in diameter. The resulting slurry was pulverized for 4 hours in a wet ball will with alumina beads 1/16 inch in diameter to obtain a ferrite slurry (finely pulverized pre-baked ferrite).

Step 4 (Granulation Step):

1.0 part of aluminum polycarbonate as a dispersant and 2.0 parts of polyvinyl alcohol as a binder were added per 100 parts of the pre-baked ferrite to the ferrite slurry, which was then granulated into spherical particles in a spray dryer (manufactured by Ohkawara Kakohki Co., Ltd.). The resulting particles were subjected to particle size adjustment, and heated for 2 hours at 650° C. in a rotary kiln to remove the organic components of the dispersant and binder.

Step 5 (Baking Step):

The temperature was raised from room temperature to 1,300° C. over 2 hours using a nitrogen atmosphere (oxygen concentration 1.00 volume %) in an electrical furnace to control the baking atmosphere, and the particles were baked for 4 hours at 1,150° C. The temperature was then lowered to 60° C. over the course of 4 hours, the atmosphere was returned from nitrogen to air, and the particles were taken out at 40° C. or less.

Step 6 (Selection Step):

Aggregated particles were broken up, the low-magnetic product were excluded with a magnetic separation, and coarse particles were removed by sieving with a 250 μm mesh sieve to obtain a magnetic core particle 1 with a 50% particle diameter (D50) of 37.0 μm based on volume distribution.

(Preparation of Coating Resin 1)

| | |
|---|---|
| Cyclohexyl methacrylate monomer | 26.8 parts |
| Methyl methacrylate monomer | 0.2 part |
| Methyl methacrylate macromonomer (macromonomer with weight-average molecular weight of 5000 having methacryloyl group at one end) | 8.4 parts |
| Toluene | 31.3 parts |
| Methyl ethyl ketone | 31.3 parts |
| Azobisisobutyronitrile | 2.0 parts |

Of these materials, the cyclohexyl methacrylate monomer, methyl methacrylate monomer, methyl methacrylate macromonomer, toluene and methyl ethyl ketone were added to a four-necked separable flask with an attached reflux condenser, thermometer, nitrogen introduction pipe and stirring apparatus, and nitrogen gas was introduced to obtain a sufficient nitrogen atmosphere.

This was then heated to 80° C., and the azobisisobutyronitrile was added and refluxed for 5 hours to polymerize the mixture. Hexane was poured into the resulting reaction product to precipitate a copolymer, and the precipitate was filtered out and vacuum dried to obtain a coating resin 1. 30 parts of the resulting coating resin 1 were dissolved in a mixture of 40 parts of toluene and 30 parts of methyl ethyl ketone to obtain a polymer solution 1 (30 mass % of solids).

(Preparation of Coating Resin Solution 1)

| | |
|---|---|
| Polymer solution 1 (resin solids concentration 30%) | 33.3 parts |
| Toluene | 66.4 parts |
| Carbon black (Regal 330; Cabot Corp.) (primary particle size 25 nm, nitrogen adsorption specific surface area 94 $m^2/g$, DBP oil absorption 75 mL/100 g). | 0.3 part |

These materials were dispersed for 1 hour with a paint shaker using zirconia beads 0.5 mm in diameter. The resulting dispersion was filtered with a 5.0 μm membrane filter to obtain a coating resin solution 1.

(Resin Coating Step):

The coating resin solution 1 was loaded into a vacuum degassing kneader maintained at normal temperature so that the loaded amount of the coating resin solution 1 was 2.5 parts (of the resin component) per 100 parts of the magnetic core particle 1. This was then stirred for 15 minutes at a rotational speed of 30 rpm to evaporate at least a specific amount of the solvent (80 mass %).

Next, the temperature was raised to 80° C. with reduced pressure mixing, the toluene was removed over the course of 2 hours, and the mixture was cooled. A magnetic separation was carried out to separate the low magnetic particles from the resulting magnetic carrier, which was then passed through a 70 μm mesh sieve and classified with an air classifier to obtain a magnetic carrier 1 with a 50% particle diameter (D50) based on volume distribution of 38.2 μm.

<Manufacturing Example of Two-Component Developer 1>

92.0 parts of the magnetic carrier 1 and 8.0 parts of the Toner 1 were mixed with a V-type mixer (V-20, Seishin Enterprise Co., Ltd.) to obtain a two-component developer 1.

<Manufacturing Examples of Two-Component Developers 2 to 20>

The two-component developers 2 to 20 were obtained as in the manufacturing example of the two-component developer 1 except that the Toners 2 to 20 were substituted for the Toner 1.

Example 1

The following evaluations were performed using the resulting two-component developer 1.

<Evaluation of Low-Temperature Fixability>

Using a modified full-color imagePress C800 copier (Canon Inc.), the two-component developer 1 was placed in the cyan developing device, and the fixing temperature range was tested.

The copier was modified so that the fixing temperature, process speed, DC voltage Vdc of the developer bearing member, charging voltage Vd of the electrostatic latent image-bearing member and laser power could be set at will.

For the image, an unfixed image with an image print percentage of 25% was prepared in a normal-temperature normal-humidity environment (23° C., at least 50% RH and not more than 60% RH) with the toner laid-on level on the paper adjusted to 1.4 mg/cm$^2$. GF-0081 copy paper (A4, basis weight 81.4 g/m$^2$, purchased from Canon Marketing Japan Inc.) was used as the evaluation paper.

Subsequently, in a low-temperature, low-humidity environment (15° C., RH≤10%) with the process speed set to 450 mm/sec, the fixing temperature was raised from 120° C. in 5° C. increments, and the lowest temperature at which no offset occurred was given as the cold fixing temperature. The evaluation results are shown in Table 3.

(Evaluation Standard)

A: Less than 155° C.

B: At least 155° C. and less than 160° C.

C: At least 160° C. and less than 165° C.

D: At least 165° C.

<Evaluation of Hot Offset Resistance>

The fixing temperature range of the two-component developer 1 was tested using the same evaluation unit used to evaluate low-temperature fixability above. For the image, an unfixed image with an image print percentage of 25% was prepared in monochrome mode in a normal-temperature, normal-humidity environment (23° C., at least 50% RH and not more than 60% RH) with the toner laid-on level on the paper adjusted to 0.10 mg/cm$^2$. CS-680 copy paper (A4, basis weight 68.0 g/m$^2$, purchased from Canon Marketing Japan Inc.) was used as the evaluation paper.

Subsequently, in a normal-temperature, low-humidity environment (23° C., RH≤5%) with the process speed set to 450 mm/sec, the fixing temperature was raised from 160° C. in 5° C. increments, and the highest temperature at which no offset occurred was given as the hot offset resistance temperature.

The hot offset resistance temperature is ranked on the basis of the following standard. The evaluation results are shown in Table 3.

(Evaluation Standard)

A: At least 210° C.

B: At least 200° C. and less than 210° C.

C: At least 190° C. and less than 200° C.

D: Less than 190° C.

<Evaluation of Durable Stability (Charge Stability)>

Using a modified full-color imagePress C800 copier (Canon Inc.), the two-component developer 1 was placed in the cyan developing device of the copier, and evaluated as follows.

The copier was modified by removing the mechanism that discharges excessive magnetic carrier in the developing device from the developing device.

The toner laid-on level on the paper in an FFh image (solid image) was adjusted to 0.45 mg/cm$^2$. "FFh" is a value obtained by displaying 256 gradations in hexadecimal notation, with 00h being the first of the 256 gradations (white background) and FFh the 256th gradation (solid part).

10,000 sheets of the image were output at an image ratio of 20% in a normal-temperature, normal humidity environment (23° C., at least 50% RH and not more than 60% RH) and a high-temperature, high-humidity environment (30° C., 80% RH). During this output, paper was fed under the same developing conditions and transfer conditions (without calibration) as for the first sheet. GF-C081 1-copy plain paper (A4, basis weight 81.4 g/m$^2$, purchased from Canon Marketing Japan Inc.) was used as the evaluation paper.

The initial (1st) and 10,000th output sheets were evaluated as follows.

(Measurement of Image Density)

The image densities of the FFh image parts (solid parts) of the initial (1st) sheet and 10,000th sheet were measured with an X-Rite color reflection densitometer (500 Series: X-Rite Co.), and a rank was assigned according to the following standard based on the difference Δ between the two image densities. The evaluation results are shown in Table 3.

(Evaluation Standard)

A: Less than 0.05

B: At least 0.05 and less than 0.10

C: At least 0.10 and less than 0.15

D: At least 0.15

Examples 2 to 18, Comparative Examples 1 to 4

Evaluations were performed as in Example 1 except that the two-component developers shown in Table 3 were substituted for the two-component developer used in the evaluation. The evaluation results are shown in Table 3.

TABLE 3

| | Two-component developer | | Low-temperature fixability | | Hot offset resistance | | Durable stability | |
|---|---|---|---|---|---|---|---|---|
| | No. | Toner No. | Temperature (° C.) | Evaluation | Temperature (° C.) | Evaluation | Density difference | Evaluation |
| Example 1 | 1 | 1 | 148 | A | 215 | A | 0.01 | A |
| Example 2 | 2 | 2 | 150 | A | 213 | A | 0.01 | A |
| Example 3 | 3 | 3 | 149 | A | 210 | A | 0.02 | A |
| Example 4 | 4 | 4 | 154 | A | 209 | B | 0.01 | A |
| Example 5 | 5 | 5 | 153 | A | 208 | B | 0.02 | A |
| Example 6 | 6 | 6 | 152 | A | 208 | B | 0.01 | A |
| Example 7 | 7 | 7 | 154 | A | 207 | B | 0.03 | A |
| Example 8 | 8 | 8 | 156 | B | 207 | B | 0.03 | A |
| Example 9 | 9 | 9 | 155 | B | 208 | B | 0.03 | A |
| Example 10 | 10 | 10 | 158 | B | 203 | B | 0.04 | A |
| Example 11 | 11 | 11 | 159 | B | 202 | B | 0.04 | A |
| Example 12 | 12 | 12 | 158 | B | 203 | B | 0.05 | B |
| Example 13 | 13 | 13 | 159 | B | 202 | B | 0.06 | B |
| Example 14 | 14 | 14 | 161 | C | 201 | B | 0.07 | B |
| Example 15 | 15 | 15 | 161 | C | 200 | B | 0.08 | B |
| Example 16 | 16 | 16 | 162 | C | 197 | C | 0.09 | B |
| Example 17 | 17 | 17 | 163 | C | 195 | C | 0.10 | C |
| Example 18 | 18 | 18 | 164 | C | 190 | C | 0.14 | C |
| Comparative Example 1 | 19 | 19 | 168 | D | 185 | D | 0.15 | D |
| Comparative Example 2 | 20 | 20 | 169 | D | 187 | D | 0.04 | A |
| Comparative Example 3 | 21 | 21 | 169 | D | 186 | D | 0.04 | A |
| Comparative Example 4 | 22 | 22 | 148 | A | 189 | D | 0.16 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-118318, filed Jun. 16, 2017, which is hereby incorporated by reference herein in its entirety.

What is claimed is:

1. A toner, comprising a toner particle containing a polyester resin as a binder resin and a fatty acid metal salt wherein, when a tetrahydrofuran-soluble component is extracted from the toner, the tetrahydrofuran-soluble component includes a tetrahydrofuran-soluble component A having a molecular weight of 1,000 to 5,000, the molecular weight being measured by gel permeation chromatography, the tetrahydrofuran-soluble component A is contained in the toner in an amount of 25 to 80% in mass, a mass ratio of the fatty acid metal salt to the tetrahydrofuran-soluble component A is 0.003 to 0.060, and the fatty acid metal salt in the toner has a number-average dispersion diameter of 50 to 500 nm, the number-average dispersion diameter being calculated based on the observation of the fatty acid metal salt exposed in a cross-section of the toner particle with the use of a transmission electron microscope.

2. The toner according to claim 1, wherein a melting point of the fatty acid metal salt is 80 to 170° C.

3. The toner according to claim 1, wherein the fatty acid metal salt includes at least one fatty acid metal salt selected from the group consisting of magnesium stearate, magnesium distearate, calcium laurate and calcium dilaurate.

4. The toner according to claim 2, wherein the fatty acid metal salt includes at least one fatty acid metal salt selected from the group consisting of magnesium stearate, magnesium distearate, calcium laurate and calcium dilaurate.

5. The toner according to claim 1, wherein the polyester resin contains a low-molecular-weight polyester resin (L) and a high-molecular-weight polyester resin (H), and the high-molecular-weight polyester resin (H) has a peak molecular weight (Mp) of 9,000 to 13,000.

6. The toner according to claim 5, wherein the low-molecular-weight polyester resin (L) has a peak molecular weight (Mp) of 2,500 to 7,000.

7. The toner according to claim 5, wherein a mass ratio (H/L) of the high-molecular-weight polyester resin (H) to the low-molecular-weight polyester resin (L) is from 10/90 to 60/40.

8. The toner according to claim 1, wherein a content of the fatty acid metal salt is from 0.1 to 5.0 mass parts per 100 mass parts of the polyester resin.

* * * * *